US006971568B2

(12) United States Patent
Schiestl et al.

(10) Patent No.: US 6,971,568 B2
(45) Date of Patent: Dec. 6, 2005

(54) COMBUSTION-OPERATED SETTING DEVICE

(75) Inventors: Ulrich Schiestl, Feldkirch (AU); Ulrich Rosenbaum, Wangs (CH); Iwan Wolf, Chur (CH); Hans Gschwend, Buchs (CH); Peter Hertlein, Gams (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/786,208

(22) Filed: Feb. 25, 2004

(65) Prior Publication Data

US 2004/0232191 A1 Nov. 25, 2004

(30) Foreign Application Priority Data

Feb. 27, 2003 (DE) ..... 103 08 359

(51) Int. Cl.[7] ..... B25C 1/08; B27F 7/09

(52) U.S. Cl. ..... 227/8; 227/10

(58) Field of Search ..... 227/8, 9, 10, 130; 173/2

(56) References Cited

U.S. PATENT DOCUMENTS

| | | | | |
|---|---|---|---|---|
| 3,967,771 | A * | 7/1976 | Smith | 227/10 |
| 4,074,843 | A * | 2/1978 | Oesterle | 227/8 |
| 5,213,247 | A * | 5/1993 | Gschwend et al. | 227/10 |
| 5,909,836 | A * | 6/1999 | Shkolnikov et al. | 227/8 |
| 6,247,626 | B1 * | 6/2001 | MacVicar | 227/10 |
| 6,679,410 | B2 * | 1/2004 | Wursch et al. | 227/2 |
| 6,843,401 | B2 * | 1/2005 | Favre-Bulle | 227/10 |

* cited by examiner

*Primary Examiner*—Scott A. Smith
*Assistant Examiner*—Gloria R. Weeks
(74) *Attorney, Agent, or Firm*—Abelman, Frayne, Schwab

(57) ABSTRACT

The present invention is directed to a combustion-operated setting device for driving fastening elements such as nails, bolts and pins into a substrate, with a combustion chamber (12) that has at least one combustion chamber outlet (13) in which a fuel gas mixture can be ignited for driving a driving piston (16) guided in a piston guide (17), and with a locking and unlocking mechanism (20) for unlocking the at least one combustion chamber outlet (13) in the starting position (31) of the driving piston (16) and for locking the at least one combustion chamber outlet (13) outside of the starting position (31) of the driving piston (16). The locking and unlocking mechanism (20) has a magnet (21) for detecting the driving piston (16) in the starting position (31).

8 Claims, 5 Drawing Sheets

COMBUSTION-OPERATED SETTING DEVICE

BACKGROUND OF THE INVENTION

The present invention is directed to a combustion-operated setting device for driving fastening elements into a substrate, with a combustion chamber which has at least one combustion chamber outlet and in which a fuel gas mixture can be ignited for driving a driving piston guided in a piston guide, and with a locking and unlocking mechanism for unlocking the at least one combustion chamber outlet in the starting position of the driving piston and for locking the at least one combustion chamber outlet outside of the starting position of the driving piston. Setting devices of this kind can be operated by gaseous or liquid fuels that are burned in a combustion chamber and drive a driving piston for fastening elements.

In fuel-operated setting devices, e.g., with liquid-gas driving means, the piston is guided back to its initial or starting position at the combustion chamber after the ignition of the air-fuel mixture in the combustion chamber and the process triggered by this ignition for driving in the fastening element, during which the piston runs forward due to the combustion pressure. The setting device is ready to be used again for the next setting process only when the piston has returned to its starting position.

Conventionally, the piston is guided back by a thermal piston return. Shortly after combustion has taken place in the combustion chamber, the advancing piston runs past an exhaust port so that the combustion chamber pressure drops to atmospheric pressure. The pressure drops further due to the cooling of the combustion gases at the cylinder walls and a vacuum occurs in the combustion chamber which draws the piston back into its starting position. It is important that the combustion chamber remains tightly closed until the starting position of the piston to enable trouble-free functioning and for the piston to be drawn back into its starting position at the rear of the combustion chamber. If this is not the case and the combustion chamber opens before the piston has moved back completely, the vacuum is immediately canceled and the piston remains in an incorrect position. However, an opening of the combustion chamber after the setting process is also necessary to purge the exhaust gases from the combustion chamber.

DE10032310A1 provides a locking and unlocking mechanism which interrogates the displacement position of the piston to determine when it has reached its starting position again and to prevent premature opening of the combustion chamber. As soon as the locking and unlocking mechanism determines that the piston has reached its starting position again, an unlocking of the outlet valve is carried out to open and vent the combustion chamber.

The locking and unlocking mechanism is constructed as a piston feeler which senses the piston rod and can drop into the movement path of the piston rod when the piston is in its starting position at the combustion chamber. However, this is disadvantageous in that the piston feeler rubs against the piston rod during the return of the piston and accordingly impedes the return of the piston to its starting position.

In the setting device disclosed in U.S. Pat. No. 5,909,836, an opening of the combustion chamber is mechanically blocked by the actuation of the trigger switch (for triggering the setting device). Accordingly, the combustion chamber cannot be opened until the trigger switch is in its inoperative position again. The return movement of the trigger switch to the inoperative position and, therefore, the opening of the combustion chamber are delayed by a delay device until the piston has returned to its starting position completely within the delay time period. However, this solution is disadvantageous in that rapid operation is impossible because after every setting process it is necessary to wait until the delay time of the trigger switch expires before another setting process can be carried out.

SUMMARY OF THE INVENTION

It is the object of the present invention to develop a setting device which overcomes the aforementioned disadvantages. According to the invention, this object is met by a combustion-operated setting device for driving fastening elements into a substrate, with a combustion chamber which has at least one combustion chamber outlet and in which a fuel gas mixture can be ignited for driving a driving piston guided in a piston guide, and with a locking and unlocking mechanism for unlocking the at least one combustion chamber outlet in the starting position of the driving piston and for locking the at least one combustion chamber outlet outside of the starting position of the driving piston.

The locking and unlocking mechanism for unlocking the at least one combustion chamber outlet in the starting position of the driving piston has a magnet for detecting the driving piston in the starting position. By using a magnet in accordance with the invention for detecting the presence of the driving piston in its starting position, mechanical contact with the driving piston or its piston rod during the return of the piston can be prevented so that incorrect positions of the piston seldom occur.

In an advantageous embodiment of the invention, the locking and unlocking mechanism has a swivelable locking device cooperating with the magnet. In the starting position of the driving piston, the locking device is swiveled by the magnet into an unlocked position for the combustion chamber outlet, while it is in a locked position when the piston is not in its starting position. Through the use of a swivelable locking with a magnet, the locking and unlocking mechanism according to the invention can be constructed from very few parts (e.g., only two parts). A setting device according to the invention is therefore economical to produce.

The magnet is advantageously arranged directly at the locking device, cooperating with and magnetically attracting the head of the driving piston in the starting position of the driving piston. The magnetic attractive force on the head of the piston results in the advantage that the magnetic attractive force of the magnet acts in the direction of the piston return and therefore assists in a complete return.

An armature for the magnet is advantageously arranged at the side of the driving piston facing the combustion chamber; the magnet draws toward the armature in the starting position of the driving piston.

It is further advantageous when the locking device is constructed as a springing-elastic clip which is fastened at one of its ends to a structural component part of the setting device and is provided at its other, free end with a lock member which engages in a counter-lock in the locked position of the locking and unlocking mechanism to lock the combustion chamber outlet. The lock member and locking device are pretensioned or biased in a direction of the unlocked position by spring force, which acts counter to the magnetic attractive force of the magnet for the driving piston. A very simple, low-wear construction of the locking and unlocking mechanism can be achieved through this step.

When the combustion chamber outlet is constructed such that the combustion chamber wall can be lifted from the floor of the combustion chamber in the setting direction, a very simple construction of the locking and unlocking mechanism can be achieved such that one end of the locking device or clip is fastened to an end of the piston guide facing the combustion chamber and the counter-lock is arranged on the inside at the combustion chamber wall. By this step, a displacement of the combustion chamber wall relative to the piston guide can be prevented in the locked position of the device, while a displacement of the combustion chamber wall in the setting direction and, therefore, an opening of the combustion chamber outlet is possible when the locking device and lock member are swiveled out of the counter-lock.

It is also advantageous when the locking and unlocking mechanism is provided with means for compulsory unlocking by which the locking and unlocking mechanism can be moved manually into the unlocked position in case of an incorrect position of the piston.

This step is advantageous in that it is possible to vent the combustion chamber even when the incorrect position of the piston cannot be overcome directly.

In an advantageous construction for compulsory unlocking, the latter is carried out in that the combustion chamber wall is at least partly rotatable around the setting axis of the setting device. Due to the partial rotation of the combustion chamber wall around the setting axis, the lock member can be moved manually out of its position in which it engages behind the counter-lock arranged at the combustion chamber wall. In this way, compulsory unlocking is provided in a very simple manner.

BRIEF DESCRIPTION OF THE DRAWINGS

Further advantages and steps of the invention are provided with reference to the drawings, wherein.

DETAILED DESCRIPTION OF THE INVENTION

Figure 1:
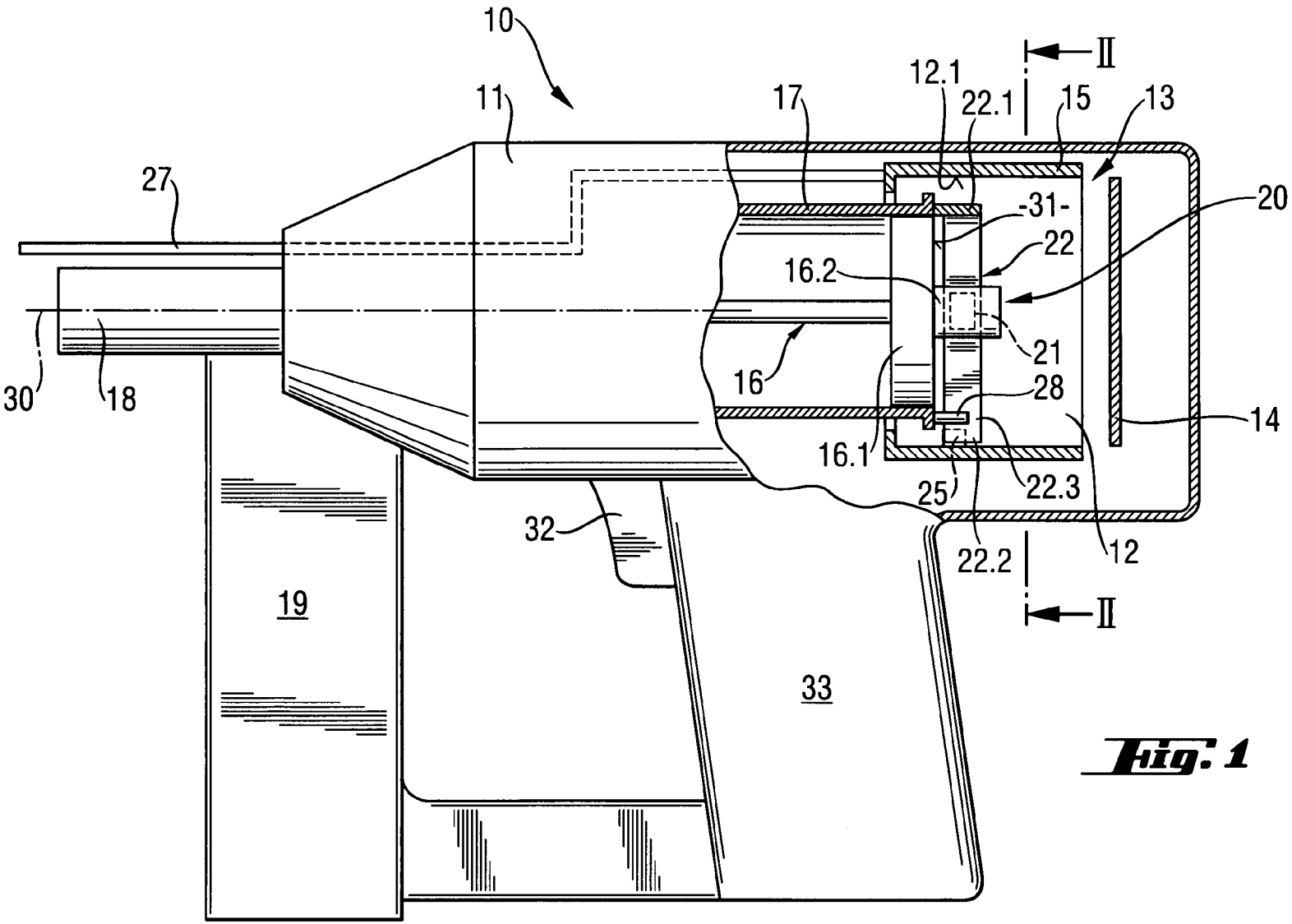
FIG. 1 is a view of a setting device according to the invention in partial longitudinal section corresponding to plane I—I in FIG. 2 in the unlocked position of a locking and unlocking mechanism with open combustion chamber outlet.
Figure 2:
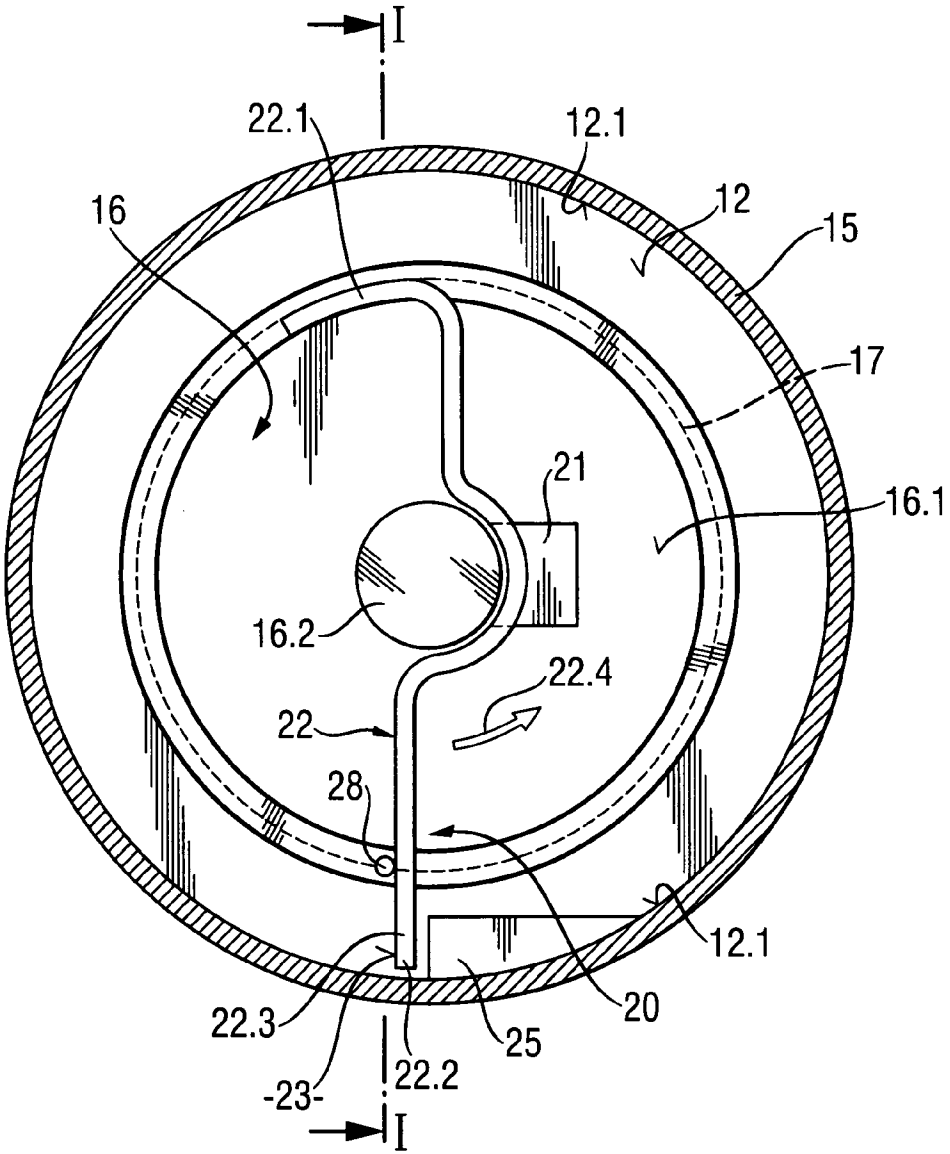
FIG. 2 shows a cross section through the setting device according to line II—II from FIG. 1.

The setting device 10 according to the invention is shown in its starting or rest position in FIGS. 1 and 2. In the present embodiment example, the setting device 10 is operated by a fuel gas which is stored in a fuel gas vessel, not shown, at the setting device. The setting device 10 has a housing 11 in which a setting mechanism is arranged for driving fastening elements into a substrate. The setting mechanism includes a combustion space or combustion chamber 12, a piston guide 17 in which a driving piston 16 is displaceably mounted, and a pin guide 18 for guiding a fastening element. Fastening elements can be stored in a magazine 19 at the setting device 10.

In the present embodiment, an ignition unit (not shown in the drawing) is also provided in the combustion chamber 12 for igniting an air/fuel gas mixture introduced into the combustion chamber 12 for a setting process. A switching device, e.g., a trigger switch 32, is provided at a handle 33 of the setting device 10 for triggering a setting process after the setting device 10 is pressed against a substrate.

The combustion chamber 12 is formed by a combustion chamber wall 12.1 which is constructed as a sleeve 15 and which opens at the front into the piston guide 17. A rear wall 14 of the combustion chamber which closes the combustion chamber 12 at the rear is located at the rear end of the sleeve 15. A combustion chamber outlet 13 formed between the combustion chamber rear wall 14 and the sleeve 15, which is pushed forward slightly, is open in the starting position or rest position of the setting device 10, shown in FIG. 1, in which the setting device 10 is not pressed against the substrate. The sleeve 15 is pushed forward slightly over the piston guide 17 for this purpose. In this position, the sleeve 15 is held by a spring element, not shown.

The combustion chamber 12 can be filled with fresh air and the propellant gas expelled through the combustion chamber outlet 13. The combustion chamber outlet 13 can be connected to an exhaust and/or air inlet of the setting device for this purpose.

Further, a locking and unlocking mechanism, designated in its entirety by 20, which will be described more fully in the following is arranged at the setting device 10. This locking and unlocking mechanism 20 includes a locking device 22, a counter-lock 25 and a magnet 21.

The counter-lock 25 for the locking device 22 which will be described more fully in the following with reference to FIG. 2 is arranged inside at the combustion chamber wall 12.1 in the region of the sleeve 15.

In FIG. 1, the driving piston 16 is in its starting position at the rear end of the piston guide 17. An armature 16.2 which is oriented toward the combustion chamber 12 and comprises a metal that can be attracted magnetically is arranged at the head 16.1 of the driving piston.

One end 22.1 of the locking device is fastened to the piston guide 17 at the end of the piston guide 17 facing the combustion chamber 12. As can be seen from FIG. 2, the locking device 22 is constructed as a spring clip. The locking device 22 has a curve in its middle area which partially encloses the armature 16.2 of the driving piston 16 in the starting position 31. The magnet 21 is arranged at this curve, the locking device 22 being attracted to the armature 16.2 of the driving piston 16 in the starting position 31 of the driving piston 16 (see FIGS. 1 and 2) by the magnet 21 due to its magnetic attractive force. This magnetic attraction takes place against the elastic spring force 22.4 of the locking device 22, which is constructed as a spring clip. Because of the magnetic attraction of the magnet 21 to the armature 16.2 at the head 16.1 of the driving piston 16, a free end 22.2 of the locking device 22 constructed as a lock member 22.3 is held in its unlocked position 23 relative to the counter-lock 25 at the combustion chamber wall 12.1. In this unlocked position 23, the combustion chamber outlet 13 can be opened or closed by a movement of the actuating means 27 by pressing the setting device 10 against a substrate 40 or lifting the setting device 10 from the substrate 40 and by a resulting displacement of the sleeve 15 relative to the combustion chamber rear wall 14. A stop 28 at the piston guide 17 prevents the locking device 22 from being swiveled so far due to the magnetic attractive force that the piston can no longer return to its starting position 31.

Figure 3:
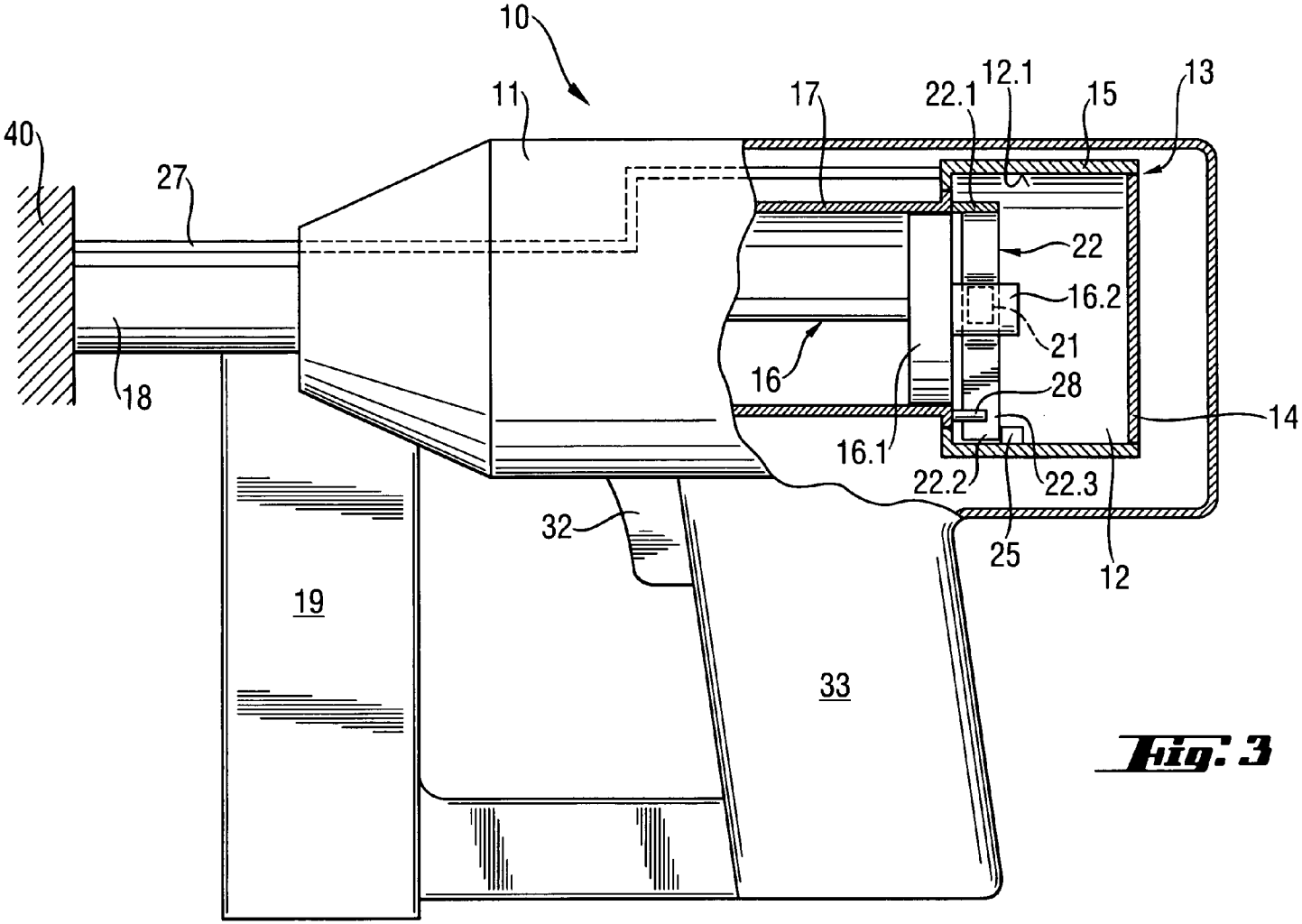
FIG. 3 shows a view of the setting device of FIG. 1 in partial longitudinal section in the unlocked position of the locking and unlocking mechanism with closed combustion chamber outlet, wherein the setting device is pressed against a substrate.

In FIG. 3, the setting device 10 was pressed against a substrate 40 so that the sleeve 15 was displaced toward the rear against the force of the spring element, not shown, by the actuating means 27, so that the combustion chamber outlet 13 was closed such that, on the one hand, the combustion chamber rear wall 14 moves into the sleeve 15 and, on the other hand, the sleeve tightly contacts the end of the piston guide 17 on the combustion chamber side. An ignitable air-fuel mixture can now be introduced into the combustion chamber 12 through a fuel supply, not shown, and an oxidizer supply or air supply, not shown. After the combustion chamber 12 is completely filled with the air-fuel mixture, a setting process can be initiated by the trigger switch 32 at the handle 33.

Figure 4:
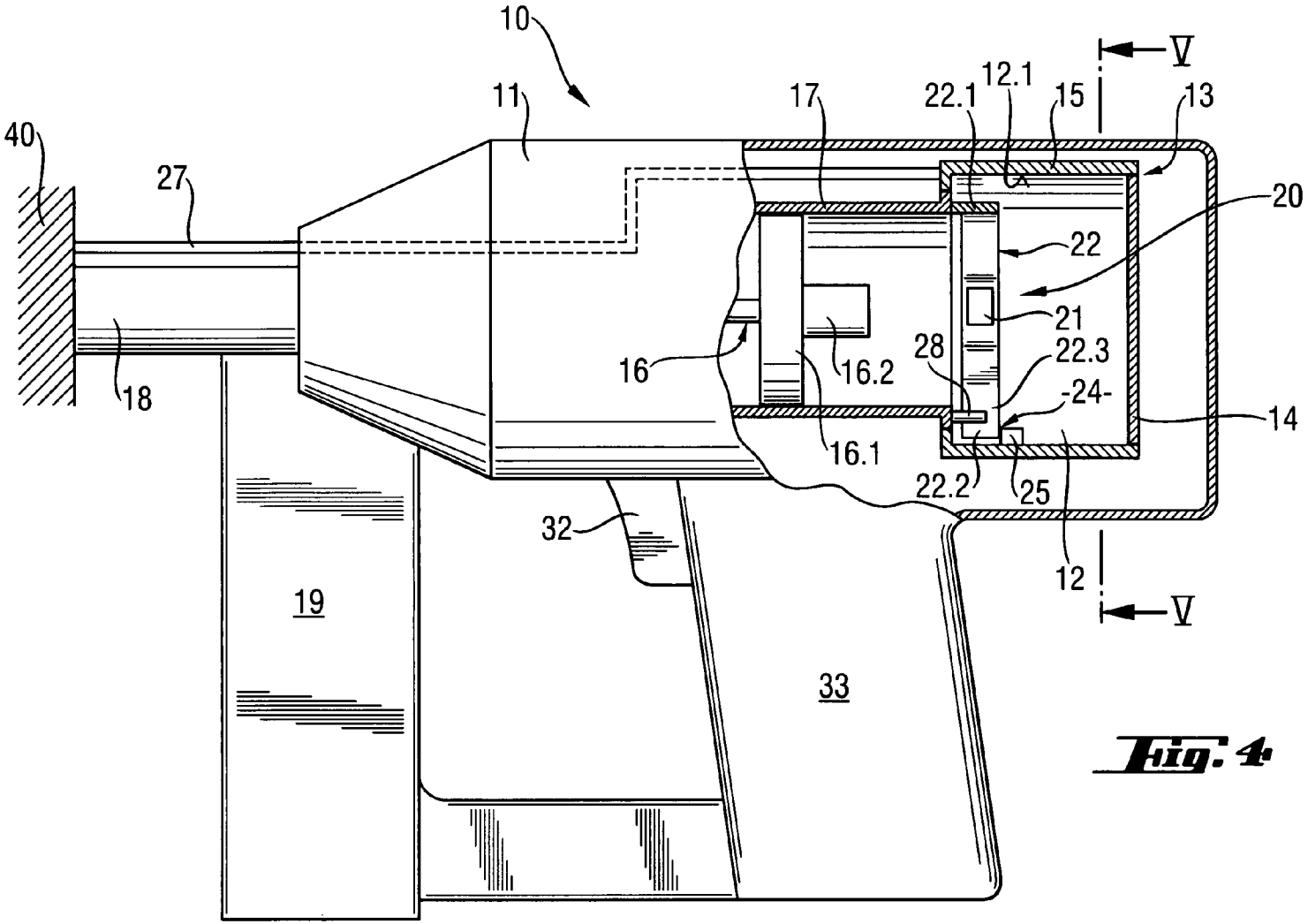
FIG. 4 shows the setting device of FIG. 1 in a partial longitudinal sectional view in the locked position of the locking and unlocking mechanism with closed combustion chamber outlet.

In FIG. 4, the driving piston 16 has been driven forward by its head 16.1 due to the expanding propellant gases from the combustion of the air-fuel mixture in the combustion chamber 12, so that a fastening element, not shown, was partially driven into a substrate 40 by the driving piston 16. Along with the driving piston 16, the armature 16.2 has also been moved out of its position at the locking device 22. The locking device 22 which is now no longer held by the magnetic attractive force of the magnet 21 to the armature 16.2 has moved into its locked position 24 at the counter-lock 25 due to its inherent spring force (reference number 22.4 in FIG. 2), in which locked position 24 the lock member 22.3 is located behind the counter-lock 25 (see FIG. 5). The combustion chamber outlet 13 cannot be opened in this locked position 24 because the sleeve 15 can no longer move forward away from the combustion chamber rear wall 14 even when the setting device 10 is lifted from the substrate 40.

At the conclusion of the setting process, the setting piston 16 along with its head 16.1 and the armature 16.2 is drawn back again into its starting position 31 shown in FIG. 1 due to the cooling reaction gases and propellant gases from the combustion of the air-fuel mixture in the combustion chamber 12. This moving back of the driving piston 16 is carried out without being obstructed by the locking device 22 which remains in its swiveled out position or locked position 24 until the armature 16.2 moves into or approaches the combustion chamber 12. On the contrary, the moving back of the driving piston 16 is reinforced by the magnetic attractive force of the magnet 21 on the driving piston 16 and its armature 16.2. As soon as the piston 16 is in its starting position 31 again (see FIG. 1), the locking device 22 is attracted to the armature 16.2 again by the magnet 21 arranged at the locking device 22, so that the lock member 22 is moved from its locked position 24, shown in FIG. 5, into its unlocked position 23 again (see. FIG. 2). It is now possible for the combustion chamber outlet 13 to open when the setting device 10 is lifted from the substrate.

Figure 5:
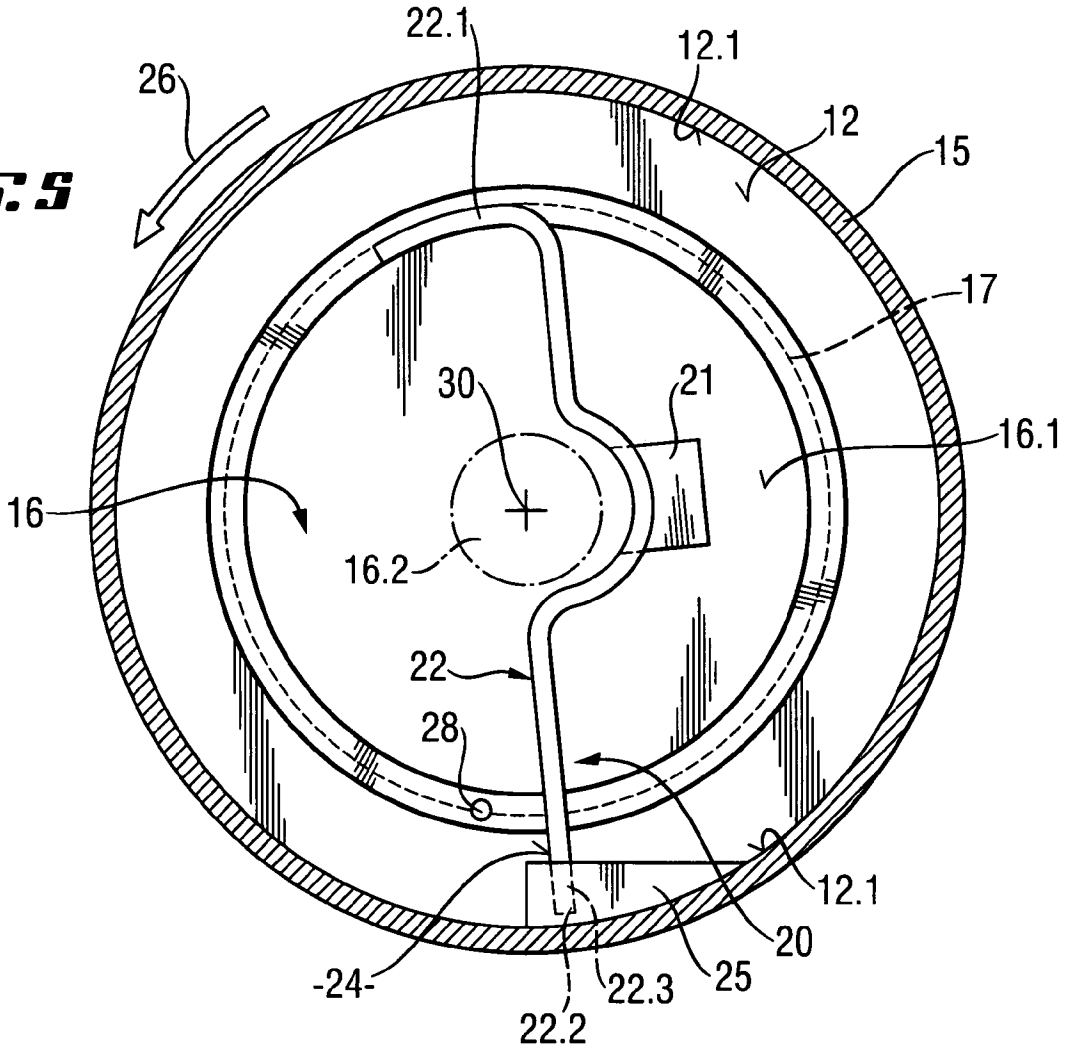
FIG. 5 shows a cross section through the setting device according to line V—V of FIG. 4.

Compulsory unlocking of the combustion chamber outlet 13 is also possible as can be seen from FIG. 5. For this purpose, the sleeve 15 is at least partially rotatable about the setting axis 30 as is indicated by reference number 26. When the sleeve 15 is rotated corresponding to reference number 26, e.g., by manual actuation on the part of the user, the counter-lock 25 is moved away from the lock member 22.3 in counterclockwise direction in a corresponding manner, so that an unlocked position can likewise be achieved. This step is particularly advantageous when the piston has not moved back completely into its starting position and is in an incorrect position.

It remains to be noted that the combustion chamber outlet can also be constructed differently than shown herein. For example, it can be constructed as a valve which can be actuated by actuating means and which can be unlocked or locked by the locking and unlocking mechanism. Further, the locking device and the magnet could also be arranged in the area of the end of the piston or piston rod in the setting direction, for example.

What is claimed is:

1. A combustion-operated setting device for driving fastening elements such as nails, bolts and pins into a substrate, with a combustion chamber (12) that has at least one combustion chamber outlet (13) and in which a fuel gas mixture can be ignited for driving a driving piston (16) guided in a piston guide (17), and with a movable locking and unlocking mechanism (20) for unlocking the at least one combustion chamber outlet (13) in the starting position (31) of the driving piston (16) and for locking the at least one combustion chamber outlet (13) outside of the starting position (31) of the driving piston (16), wherein the movable locking and unlocking mechanism (20) has a magnet attached there to (21) for detecting the driving piston (16) in the starting position (31).

2. The setting device of claim 1, wherein the movable locking and unlocking mechanism (20) contains a swivelable locking device (22) that cooperates with the magnet (21) and is swiveled into an unlocked position (23) for the combustion chamber outlet (13) in the starting position (31) of the driving piston (16) by the magnet (21) and is in a locked position (24) for the combustion chamber outlet (13) when the driving piston (16) is not in its starting position (31).

3. The setting device of claim 2, wherein the magnet (21) is arranged at the locking device (22) and cooperates magnetically with the head (16.1) of the driving piston (16) located in its starting position.

4. The setting device of claim 3, wherein an armature (16.2) for the magnet (21) is arranged at the driving piston (16) at the side of its head (16.1) facing the combustion chamber (12).

5. The setting device of claim 3, wherein the locking device (22) is constructed as a springing-elastic clip that is fixed in a stationary manner by one end (22.1) to a structural component part of the setting device (10) and is provided at its free end (22.2) with a lock member (22.3) that cooperates with a counter-lock (25) in the locked position (24) of the locking device (22), the locking device (22) being resiliently pretensioned in a direction of its unlocked position by the spring force (22.4).

6. The setting device of claim 2, wherein a stationary end (22.1) of the locking device (22) is fixed to an end of the piston guide (17) facing the combustion chamber (12) and the counter-lock (25) is arranged inside at the combustion chamber wall (12.1).

7. The setting device of claim 6, wherein an arrangement is provided for compulsory unlocking of the movable locking and unlocking mechanism (20) by which the locking and unlocking mechanism (20) can be moved into the unlocked position (23) in a defective state of the piston.

8. The setting device of claim 7, wherein the arrangement for compulsory unlocking is formed by an at least partial rotatability (26) of the combustion chamber wall (12.1) around the setting axis (30) of the setting device (10).

* * * * *